US005184747A

United States Patent [19]

Nolte

[11] Patent Number: 5,184,747

[45] Date of Patent: Feb. 9, 1993

[54] SEAL ENGAGING RING

[75] Inventor: Paul A. Nolte, Memphis, Tenn.

[73] Assignee: Ingersoll-Dresser Pump Company, Liberty Corner, N.J.

[21] Appl. No.: 811,135

[22] Filed: Dec. 20, 1991

[51] Int. Cl.[5] ..... B65D 45/32

[52] U.S. Cl. ..... 220/319; 220/214; 220/288

[58] Field of Search ..... 220/319, 214, 266, 288; 215/274, 275, 278, 335

[56] References Cited

U.S. PATENT DOCUMENTS

| | | | |
|---|---|---|---|
| Re. 20,647 | 2/1938 | Shera | 220/214 |
| 929,485 | 7/1909 | Plunkett | 215/335 X |
| 1,748,923 | 2/1930 | Rieke . | |
| 1,997,202 | 4/1935 | Shera . | |
| 2,035,198 | 3/1936 | Schmitz et al. | 220/214 |
| 2,356,901 | 8/1944 | Wackman | 220/214 X |
| 2,980,275 | 4/1961 | Lundgren . | |
| 3,746,199 | 7/1973 | Hart et al. | 215/335 X |
| 4,164,304 | 8/1979 | Roberson | 220/214 X |
| 4,308,969 | 1/1982 | Heisler et al. | 220/266 |
| 4,785,963 | 11/1988 | Magley . | |

*Primary Examiner*—Allan N. Shoap
*Assistant Examiner*—Paul A. Schwarz
*Attorney, Agent, or Firm*—Michael H. Minns

[57] ABSTRACT

A seal engaging ring comprising an annular ring having an upper portion, a lower portion, an inner diameter and an outer diameter, the inner diameter having at least one major relieved area and the annular ring having at least one aperture for receiving a tamper indicating seal.

11 Claims, 3 Drawing Sheets

SEAL ENGAGING RING

BACKGROUND OF THE INVENTION

This invention relates to a container closure with a tamper indicating seal and more particularly to a ring for securing the tamper indicating seal.

During the storage and transport of shipping containers for materials such as liquid foodstuffs and chemicals, there is a risk that an unauthorized individual may gain access to the contents. In order to alert the recipient or end user to any possible tampering attempts, packagers and shippers have used tamper-evident closures. This type of closure typically includes frangible elements or tearable membranes or a pry-off cover or overseal which once defeated provides a visible indication of such tampering which cannot be replaced or mended back into its original form. The recipient or end user upon seeing the broken frangible elements or the cover removed is warned that unauthorized access to the contents may have occurred. The effect is to preclude the use of such foodstuffs or chemicals without careful checking to see if the contents are pure.

Any container which is received with the tamper-evident feature intact gives an indication that tampering has not occurred and those containers do not have to be additionally inspected. Since these containers may include food or chemical ingredients which are only one part of a larger combination or mixture, it is imperative that the contents not be used if they are contaminated for both cost and safety reasons. The options for tamper-evident closures are somewhat governed by the style of the container and its neck or pouring outlet.

A developing concept in the markets of today is the "returnable container" in which a container is filled with a product, shipped and used by customers, then returned to a filling station where this process can be started over. One major benefit of this process is the elimination of wastes such as the residue from the rinsing required before container disposal. Another desired feature is the prevention of the introduction of unwanted or unknown chemicals into the returnable container.

In many cases, prior art tamper-evident closures are not suitable for meeting the DOT requirements (see CFR 19, part 178.19). There are specific drop test and hydrostatic requirements for closures used on large containers which must be met if the container is transported over the road.

The foregoing illustrates limitations known to exist in present tamper-evident closures. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a seal engaging ring comprising an annular ring having an upper portion, a lower portion, an inner diameter and an outer diameter, the inner diameter having at least one major relieved area and the annular ring having at least one aperture for receiving a tamper indicating seal.

The foregoing and other aspects will become apparent from the following detailed description with the accompanying drawing figures.

BRIEF DESCRIPTION OF THE DRAWING FIGURES

FIG. 5 shows a seal engaging ring installed over the bung with a valve fitting installed in the bung.

DETAILED DESCRIPTION

The seal engaging ring is a simple device that is installed onto a container over the bung opening before the valve fitting is installed. Once the seal engaging ring is installed, the valve fitting is secured in a normal manner to the container. A tamper-evident seal wire is then connected to the valve fitting and to the seal engaging ring to provide a physical proof of tamper evidence. The tamper-evident seal wire must be broken before the valve fitting or seal engaging ring can be removed. To keep the seal engaging ring from turning on the container when someone tries to unscrew the fitting, stops are designed on the inside diameter of the seal engaging ring which engage with bosses on the bung. Apertures 15 are provided on the outer part of the seal engaging ring to provide positions to connect the tamper-evident seal wire.

Figure 3:
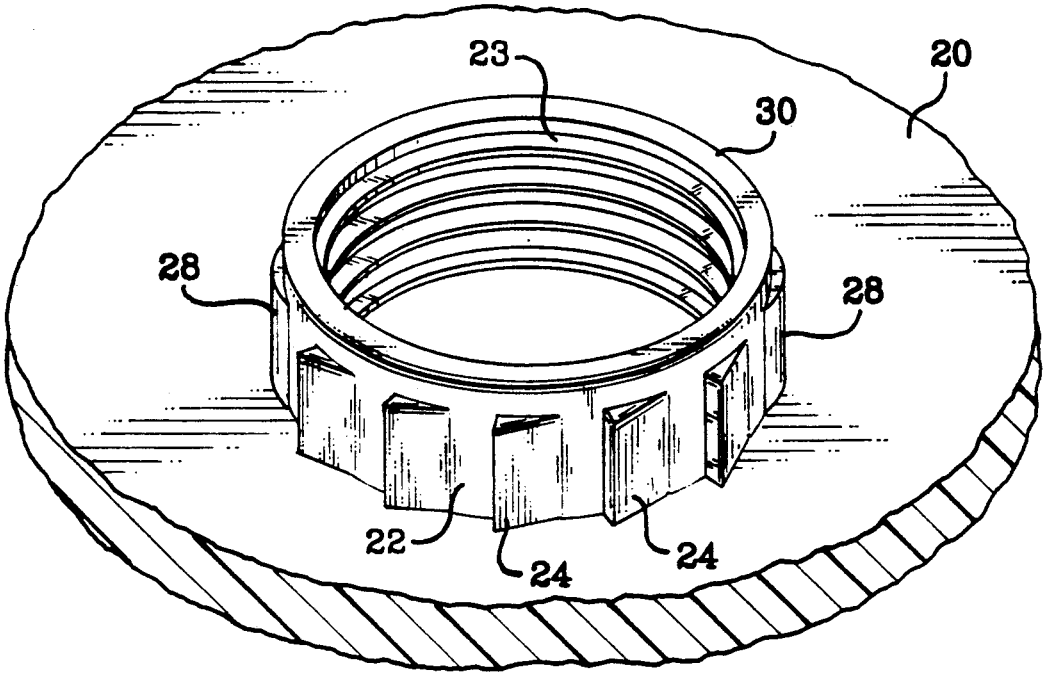
FIG. 3 is a perspective view of a portion of the top of a container showing the bung and surrounding ratchet teeth.
Figure 4:
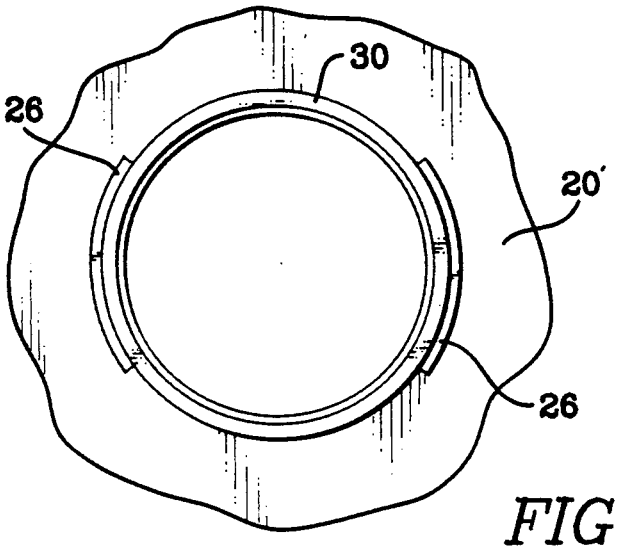
FIG. 4 is a top view of a portion of the top of an alternate container showing the bung and adjacent bosses.

FIGS. 3 and 4 show two common types of container tops 20, 20'. FIG. 3 shows the details of the bung 30 with ratchet teeth 24, exterior surface 22, and threaded interior surface 23. FIG. 4 shows the details of the bung 30 and the bosses 26. The bosses 26 and the ratchet teeth 24 are commonly used to engage typical tamper-evident closures, such as the Tamper-Evident Buttress Plug Closure described in U.S. Pat. No. 4,785,963. These bosses 26 or ratchet teeth 24 prevent the tamper-evident closures from turning once installed and sealed.

Figure 1:
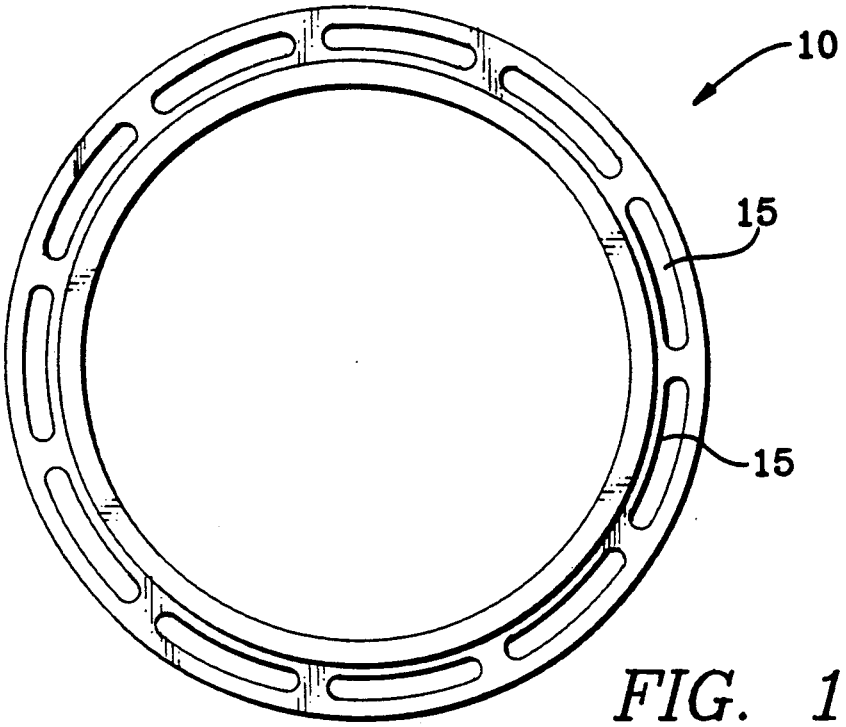
FIG. 1 is a top plan view illustrating an embodiment of a seal engaging ring.
Figure 2:
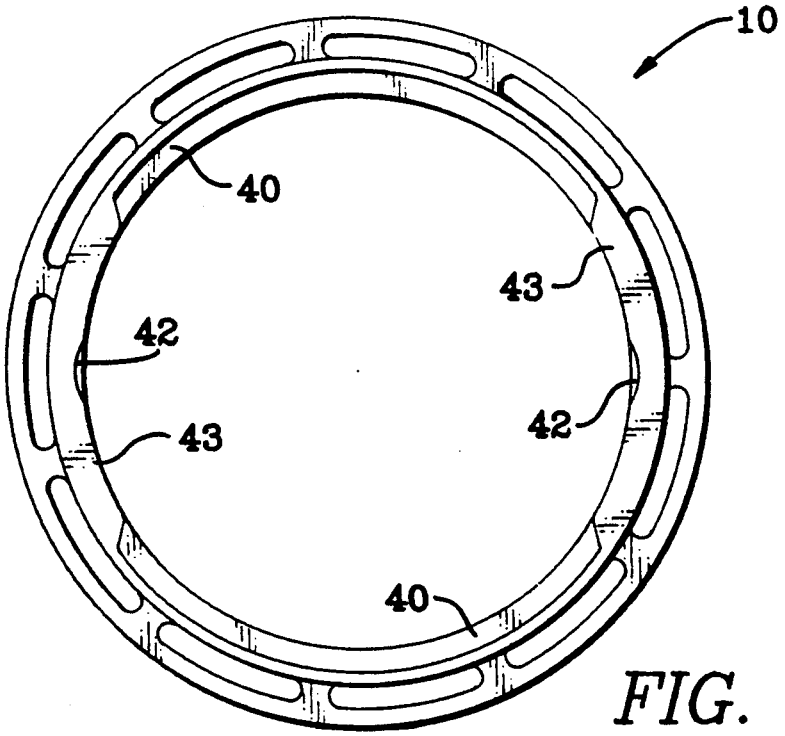
FIG. 2 is a bottom plan view of the seal engaging ring shown in FIG. 1.

FIGS. 1 and 2 show the preferred embodiment of the seal engaging ring 10. The seal engaging ring 10 has an upper portion and a lower portion. Two stops 43 are located on the inside of the lower portion of the seal engaging ring 10. These stops 43 consist of two areas of reduced diameter between the two major relieved areas 40. The stops 43 are located opposite one another.

Figure 5:
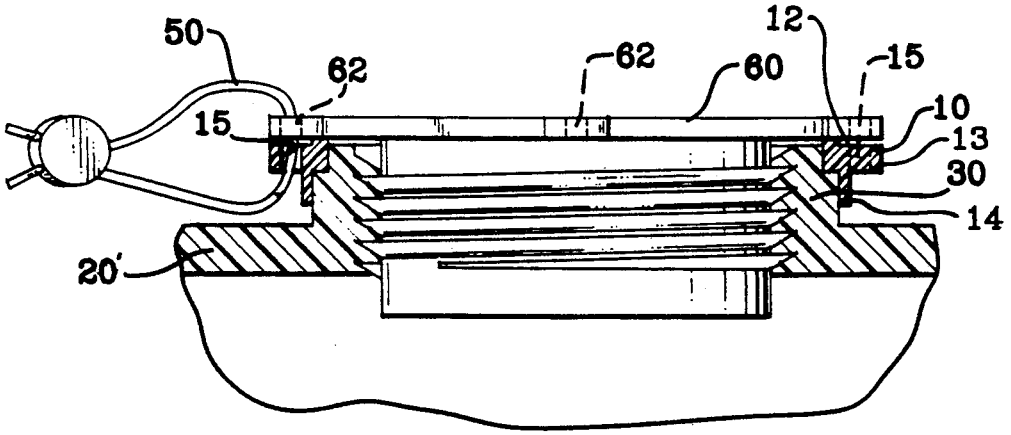
FIG. 5 is partial cross-section of the container top shown in FIG. 4.

When the seal engaging ring 10 is installed, as shown in FIG. 5, the stops 43 will engage either the bosses 26 on a container top 20' or ratchet teeth 24 on a container top 20. This allows seal engaging ring 10 to be used interchangeably on either of the common container tops 20, 20'.

The upper portion 12 of seal engaging ring 10 has a section 13 which extends outward of the lower portion 14. A plurality of seal engaging apertures 15 are located in this Section 13. At least one seal engaging aperture 15 is required.

When used, the seal engaging ring 10 is installed over the bung 30. A valve fitting 60 is then screwed into the threaded bung as shown in FIG. 5. The valve fitting 60 is externally threaded and may be a plug closure, check valve, vent valve, quick disconnect fitting or other similar fitting. The periphery of the valve fitting 60 has a plurality of seal engaging apertures 62. After the valve fitting 60 is screwed into the bung 30, a tamper-evident seal wire 50 is connected between a seal engaging aperture 62 and a seal engaging aperture 15, thereby securing the valve fitting 60 and the seal engaging ring 10 together. The stops 43 on the seal engaging ring 10 engage the bosses 26 or the ratchet teeth 24 to prevent the seal engaging ring 10 from turning. The valve fitting 60, being screwed into the bung 30, prevents the seal engaging ring 10 from being removed from the bung 30. The tamper-evident seal wire 50 prevents the valve fitting 60 from being unscrewed without breaking the wire thus providing tamper indication.

Container top 20 shows two protuberances 28 which are used with prior art tamper-evident closures. The seal engaging ring 10 has two secondary relieved areas 42 which accommodate the protuberances 28. Each secondary relieved area 42 is located in a stop 43.

Figure 2A:
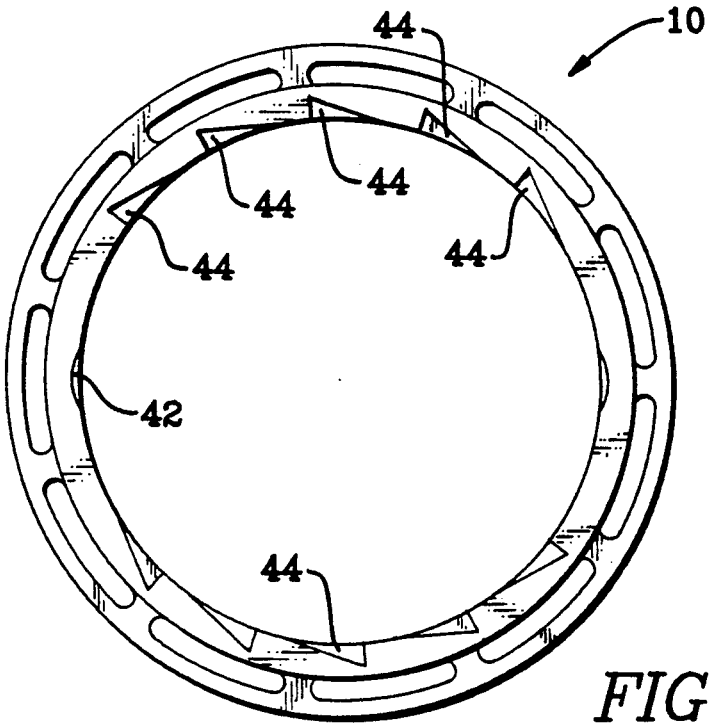
FIG. 2A is a bottom plan view of a second embodiment of the seal engaging ring shown in FIG. 1.

An alternate embodiment of the seal engaging ring 10 is shown in FIG. 2A. The upper portion of this alternate embodiment is the same as discussed above. The lower portion, as shown in FIG. 2A, contains two series of ratchet teeth engaging apertures 44. This alternate embodiment of the seal engaging ring 10 only fits onto the container top 20 shown in FIG. 3.

Having described the invention, what is claimed is:

1. In combination:

a plastic container having a raised outlet including an outer surface and an interior surface, the raised outlet outer surface being disposed with two series of ratchet teeth and the raised outlet interior surface being threaded;

an externally threaded valve fitting threadedly engageable with the interior surface of the container raised outlet, the externally threaded valve fitting having at least one seal engaging aperture;

a separate annular ring having an upper portion, a lower portion, the upper portion of the annular ring having a section which extends outward of the lower portion of the annular ring, at least one seal engaging aperture being located in said section, the annular ring having a plurality of ratchet teeth engaging apertures in its lower portion; and a tamper indicating seal for connecting said at least one seal engaging aperture of said valve fitting with said at least one seal engaging aperture of said annular ring thereby securing the valve fitting and the annular ring together.

2. The combination according to claim 1 wherein the section of the upper portion of the annular ring is continuous and defines an outer diameter which is greater than an outer diameter defined by the lower portion of the annular ring.

3. The combination according to claim 1 wherein the plurality of ratchet teeth engaging apertures on the annular ring are disposed in two series diametrically opposite each other and an inner diameter defined by of the lower portion of the annular ring has at least two secondary relieved areas, each of said secondary relieved areas being located between the two series of ratchet teeth engaging apertures.

4. In combination:

a plastic container having a raised outlet including an outer surface and an interior surface, the raised outlet outer surface being disposed with at least one boss and the raised outlet interior surface being threaded;

an externally threaded valve fitting threadedly engageable with the interior surface of the container raised outlet, the externally threaded valve fitting having at least one seal engaging aperture;

a separate annular ring having an upper portion, a lower portion and the upper portion of the annular ring having a section which extends outward of the lower portion of the annular ring, at least one seal engaging aperture being located in said section, the annular ring having at least one stop on its lower portion, the at least one stop engaging the at least one boss; and a tamper indicating seal for connecting said at least one seal engaging aperture of said valve fitting with said at least one seal engaging aperture of said annular ring thereby the valve fitting and the annular ring together.

5. The combination according to claim 4 wherein the section of the upper portion of the annular ring is continuous and defines an outer diameter which is greater than an outer diameter, defined by lower portion of the annular ring.

6. In combination:

a plastic container having a raised outlet including an outer surface and an interior surface, the raised outlet outer surface having a means for engaging a ring and the interior surface of the raised outlet being threaded;

an externally threaded valve fitting threadedly engageable with the interior surface of the container raised outlet, the externally threaded valve fitting having at least one seal engaging aperture;

a separate annular ring having an upper portion, a lower portion, the upper portion of the annular ring having a section which extends outward of the lower portion of the annular ring, at least one seal engaging aperture being located in said section, an inner diameter of the lower portion of the annular ring having two areas of reduced diameter, the areas of reduced diameter being diametrically opposite one another, the areas of reduced diameter engaging the means for engaging a ring; and a tamper indicating seal for connecting said at least one seal engaging aperture of said valve fitting with said at least one seal engaging aperture of said annular ring thereby securing the valve fitting and the annular ring together.

7. The combination according to claim 6 wherein the section of the upper portion of the annular ring is continuous and defines an outer diameter which is greater than an outer diameter defined by the lower portion of the annular ring.

8. The combination according to claim 6 wherein the means for engaging a ring comprises a pair of bosses.

9. The combination according to claim 6 wherein the means for engaging a ring comprises a plurality of ratchet teeth.

10. A seal ring comprising:

an annular ring having an upper portion and a lower portion, the outer diameter of the upper portion of the annular ring being greater than the outer diameter of the lower portion of the annular ring said upper portion forming a section which extends outward of the lower portion of the annular ring, a plurality of apertures being located in said section, an inner diameter of the lower portion of the annular ring having two major relieved areas, the two major relieved areas being diametrically opposite one another, two secondary relieved areas also being located in the lower portion of the annular ring, the two secondary relieved areas being diametrically opposite one another, the two secondary relieved areas being smaller than the major relieved areas, and each of the secondary relieved areas being located between the two major relieved areas.

11. A seal ring comprising:

an annular ring having an upper portion and a lower portion, the upper portion of the annular ring having a section which extends outward of the lower portion of the annular ring, at least one aperture being located in said section, an inner diameter of the lower portion of the annular ring having two areas of reduced diameter, the two areas of reduced diameter being diametrically opposite one another, the regions of the lower portion of the annular ring between the areas of reduced diameter defining major relieved area and two secondary relieved areas being located in the lower portion of the annular ring, the two secondary relieved areas being diametrically opposite one another, the two secondary relieved areas being smaller than the major relieved areas, and one of each of the two secondary relieved areas being located in one of the two areas of reduced diameter.

* * * * *

UNITED STATES PATENT AND TRADEMARK OFFICE

CERTIFICATE OF CORRECTION

PATENT NO. : 5,184,747

DATED : February 9, 1993

INVENTOR(S) : Paul A. Nolte

It is certified that error appears in the above—identified patent and that said Letters Patent is hereby corrected as shown below:

In Claim 4, column 4, line 21 of the Patent, after "thereby" insert --securing--.

In Claim 5, column 4, line 26 of the Patent, after "diameter" delete ",".

In Claim 5, column 4, line 26 of the Patent, after "by" insert --the--.

In Claim 11, column 6, line 8 of the Patent, change "area" to --areas--.

Signed and Sealed this

Fourteenth Day of December, 1993

Bruce Lehman

*Attest:*

BRUCE LEHMAN

*Attesting Officer*

*Commissioner of Patents and Trademarks*